US012459695B1

(12) United States Patent
Lu et al.

(10) Patent No.: US 12,459,695 B1
(45) Date of Patent: Nov. 4, 2025

(54) PLASMA STERILIZATION PACKAGING DEVICE FOR AGRICULTURAL PRODUCTS AND USING METHOD THEREOF

(71) Applicant: Zhejiang A&F University, Hangzhou (CN)

(72) Inventors: Xinghua Lu, Hangzhou (CN); Kun Fang, Hangzhou (CN); Linjiang Pang, Hangzhou (CN); Yuge Guan, Hangzhou (CN); Jiyu Cheng, Hangzhou (CN); Mingyi Yang, Hangzhou (CN); Jianliang Deng, Hangzhou (CN)

(73) Assignee: Zhejiang A&F University, Hangzhou (CN)

( * ) Notice: Subject to any disclaimer, the term of this patent is extended or adjusted under 35 U.S.C. 154(b) by 0 days.

(21) Appl. No.: 18/928,228

(22) Filed: Oct. 28, 2024

(30) Foreign Application Priority Data

Sep. 10, 2024 (CN) ..... 202411260998.9

(51) Int. Cl.

| | |
|---|---|
| ***B65B 55/16*** | (2006.01) |
| ***B65B 9/08*** | (2012.01) |
| ***B65B 25/02*** | (2006.01) |
| ***B65B 41/16*** | (2006.01) |
| ***B65B 51/30*** | (2006.01) |
| ***B65B 61/06*** | (2006.01) |

(52) U.S. Cl.
CPC ..... *B65B 55/16* (2013.01); *B65B 9/08* (2013.01); *B65B 25/02* (2013.01); *B65B 41/16* (2013.01); *B65B 51/30* (2013.01); *B65B 61/06* (2013.01)

(58) Field of Classification Search
CPC ..... B65B 55/16; B65B 9/08; B65B 25/02; B65B 41/16; B65B 51/30; B65B 61/06
USPC ..... 53/425
See application file for complete search history.

(56) References Cited

U.S. PATENT DOCUMENTS

| | | | | |
|---|---|---|---|---|
| 2002/0119073 | A1* | 8/2002 | McGowan, Jr. | A61L 2/04 422/26 |
| 2003/0170357 | A1* | 9/2003 | Garwood | B65D 21/066 705/1.1 |
| 2025/0024845 | A1* | 1/2025 | Kim | A23B 7/015 |

FOREIGN PATENT DOCUMENTS

| | | |
|---|---|---|
| CN | 112753750 A | 5/2021 |
| CN | 116138471 A | 5/2023 |

* cited by examiner

*Primary Examiner* — Veronica Martin
*Assistant Examiner* — Mary C Hibbert-Copeland
(74) *Attorney, Agent, or Firm* — Addison D. Ault; IPGentleman Intellectual Property Services, LLC

(57) ABSTRACT

A plasma sterilization packaging device for agricultural products includes a feeding unit and a packaging unit, where the packaging unit includes a first conveyor belt, an encapsulation conveyor belt and a second conveyor belt, the lower side of the first conveyor belt is provided with a roll film, the upper side of the encapsulation conveyor belt is provided with a roll film adjustment device and an upper sealing device, and a cutting sealing device is arranged between the encapsulation conveyor belt and the second conveyor belt; the upper sealing device is fixedly connected to both sides of the encapsulation conveyor belt through a first mounting frame, the lower side of the first mounting frame is provided with a hot pressing roller, the hot pressing roller is provided with a sealing positioning wheel, and one side of the sealing positioning wheel is connected to a plasma processing unit.

8 Claims, 4 Drawing Sheets

PLASMA STERILIZATION PACKAGING DEVICE FOR AGRICULTURAL PRODUCTS AND USING METHOD THEREOF

CROSS REFERENCE TO THE RELATED APPLICATIONS

This application is based upon and claims priority to Chinese Patent Application No. 202411260998.9, filed on Sep. 10, 2024, the entire contents of which are incorporated herein by reference.

TECHNICAL FIELD

The present invention relates to the field of preservation and storage technology of agricultural products, in particular to a plasma sterilization packaging device for agricultural products and using method thereof.

BACKGROUND

At present, the plasma sterilization and preservation methods for agricultural products are mainly divided into two categories:

1. Sterilization before packaging. The method is sterilizing food in the ionization region and then packaging it. The method has a good sterilization effect, but the efficiency is low. It usually needs to maintain the food in the ionization region for several minutes to achieve a complete sterilization effect. In addition, secondary pollution can easily be caused by the packaging process. For example, publication number CN116138471A has disclosed a food sterilization equipment based on low frequency and high voltage pulsed electric field combined with cold plasma. The equipment sends the sample to be processed to an electrode plate processed region through a conveyor belt to carry out sterilization treatment for a period of time, and then packaging. However, the single plasma treatment time is not less than 120 seconds, which takes too long.

2. Packaging before sterilization. The method avoids the pollution caused by secondary packaging, but the bactericidal effect of plasma will be weakened due to the presence of packaging materials, and the processing time will be prolonged accordingly. For example, publication number CN112753750A has disclosed a high-voltage electric field low-temperature plasma cold sterilization method for instant dried fruit food. The method is to place the packaged instant dried fruit in the middle of two electrode plates for intermittent multiple cycles of sterilization treatment. The single treatment time is 120 seconds with a 30-second interval, repeated 3 to 5 times for better processing effect and almost complete sterilization. However, the whole process takes a long time.

Although plasma technology has a significant effect on food sterilization and preservation, it still faces some limitations in actual production due to the long processing time. Therefore, there is an urgent need for a sterilization and packaging device that can solve the above problems.

SUMMARY

An objective of the present invention is to provide a plasma sterilization packaging device for agricultural products and using method thereof, which can solve the problem that agricultural products take too long in the plasma sterilization process and the problem of secondary pollution in the packaging process.

In order to achieve the above objective, the present invention provides a plasma sterilization packaging device for agricultural products, including a feeding unit and a packaging unit arranged on a side of the feeding unit;

the packaging unit includes a first conveyor belt, an encapsulation conveyor belt and a second conveyor belt, an upper side of the encapsulation conveyor belt is provided with a roll film adjustment device and an upper sealing device, the lower side of the first conveyor belt is provided with a roll film, and a cutting sealing device is arranged between the encapsulation conveyor belt and the second conveyor belt;

the upper sealing device is fixedly connected to both sides of the encapsulation conveyor belt through a first mounting frame, the lower side of the first mounting frame is provided with a hot pressing roller, the hot pressing roller is provided with a sealing positioning wheel on the side close to the roll film, and one side of the sealing positioning wheel is further connected to a plasma processing unit;

the cutting sealing device includes a second mounting frame, a through hole is arranged on the second mounting frame, and the through hole is sleeved in a middle part of the second conveyor belt and the encapsulation conveyor belt, and the upper and lower parts of the through hole are connected to a guillotine through a push rod;

there is a gap between the first conveyor belt and the encapsulation conveyor belt, and there is also a gap between the encapsulation conveyor belt and the second conveyor belt.

Preferably; the feeding unit includes a feeding conveyor belt, several baffles are arranged on the feeding conveyor belt at equal intervals, a cavity is formed between each two adjacent baffles, the bottom of the feeding conveyor belt is fixed on ground through a supporting leg.

Preferably, the first conveyor belt is connected to the feeding unit through a transition plate.

Preferably, the upper surface of the first conveyor belt, the encapsulation conveyor belt and the second conveyor belt are located on the same horizontal plane, and the horizontal plane height of the first conveyor belt is lower than the horizontal plane height of the feeding conveyor belt.

Preferably, the roll film is arranged on a reel, and both sides of the reel are fixedly connected to both sides of the encapsulation conveyor belt through a connecting bar.

Preferably; the hot pressing roller and the sealing positioning wheel are at the same height, with a heating sheet arranged inside the hot pressing roller, and a rolling knurl is provided on the surface of the hot pressing roller.

Preferably, both sides of the guillotine are hot pressing blocks, the middle is a cutting knife, and the heating sheet is arranged inside each hot pressing block.

Preferably, the plasma processing unit includes a plasma generator, a power regulator and a gas supply device. The plasma generator is a coaxial dual dielectric barrier reactor. The power regulator is a modulated pulse power with an output voltage is 0-30 kV and an output frequency is 5-20 KHz. The gas supply device is either gas cylinders or gas generators providing one or more of air, nitrogen, oxygen and argon.

Preferably, an upper interface of the plasma generator is a gas output interface, the gas output interface is fixed in front of the sealing positioning wheel through a gas tube, a lower interface of the plasma generator is a gas input interface, the gas input interface is connected to an outlet of the gas supply device through the gas tube, the power regulator is electrically connected to the plasma generator.

The present invention further provides a using method for a plasma sterilization packaging device for agricultural products such as the mentioned above, including the following steps:

S1, firstly, pulling the roll film out and pulling it upward to the gap between the first conveyor belt and the encapsulation conveyor belt; secondly, pulling the roll film backward, passing the two sides of the roll film through the roll film adjustment device, and bending the roll film inward through the roll film adjustment device to form a curved roll film; continuing to pull the curved roll film backward so that both sides overlap; passing the overlapped part through the sealing positioning wheel, and then passing through the hot pressing roller, and hot-pressing the overlapping part of the roll film through the hot pressing roller to make the roll film form a cylindrical shape with an opening at both ends;

S2, opening the gas supply device and the plasma generator, adjusting the output voltage between 0-30 kV and the output frequency between 5-20 kHz, and opening all conveyor belts at the same time;

S3, putting the weighed packaging materials to be sterilized into the cavity of the feeding unit;

S4, the packaging materials to be sterilized enter the roll film filled with plasma gas pass through the first conveyor belt, and as the roll film continues backward, sealing the packaging materials to be sterilized in the roll film through the cutting sealing device under the action of the upper and lower guillotine to form a single independent sealed bag.

Therefore, the present invention adopts the above-mentioned plasma sterilization packaging device for agricultural products and using method thereof, the beneficial technical effects are as follows:

(1) In the packaging process of agricultural products and food, the plasma gas is directly introduced into the packaging for sterilization, which does not affect the subsequent packing process. Compared with the conventional methods of 'sterilization before packaging' or 'packaging before sterilization', the processing time is significantly reduced and the production efficiency is improved.

(2) Compared with the method of 'sterilization before packaging', the present invention carries out plasma sterilization in the packaging process that effectively avoids the risk of secondary pollution and further ensures the safety and hygiene of the product.

REFERENCE NUMERALS IN FIGURES

1, a feeding unit; 11, a feeding conveyor belt; 12, a baffle; 13, a supporting leg; 2, a packaging unit; 21, a first conveyor belt; 22, a transition plate; 23, an encapsulation conveyor belt; 24, a roll film; 25, a roll film adjustment device; 26, a sealing positioning wheel; 27, a hot pressing roller; 28, a guillotine; 29, a push rod; 210, a hot pressing block; 211, a cutting knife; 212, a second conveyor belt; 3, a plasma processing unit; 31, a plasma generator; 32, a gas output interface; 33, a gas input interface; 34, a gas tube.

DETAILED DESCRIPTION OF THE EMBODIMENTS

The technical scheme of the present invention is further explained below by drawings and embodiments.

Unless otherwise defined, the technical or scientific terms used in the invention shall be those that belong to the present invention.

Embodiment 1

Figure 1:
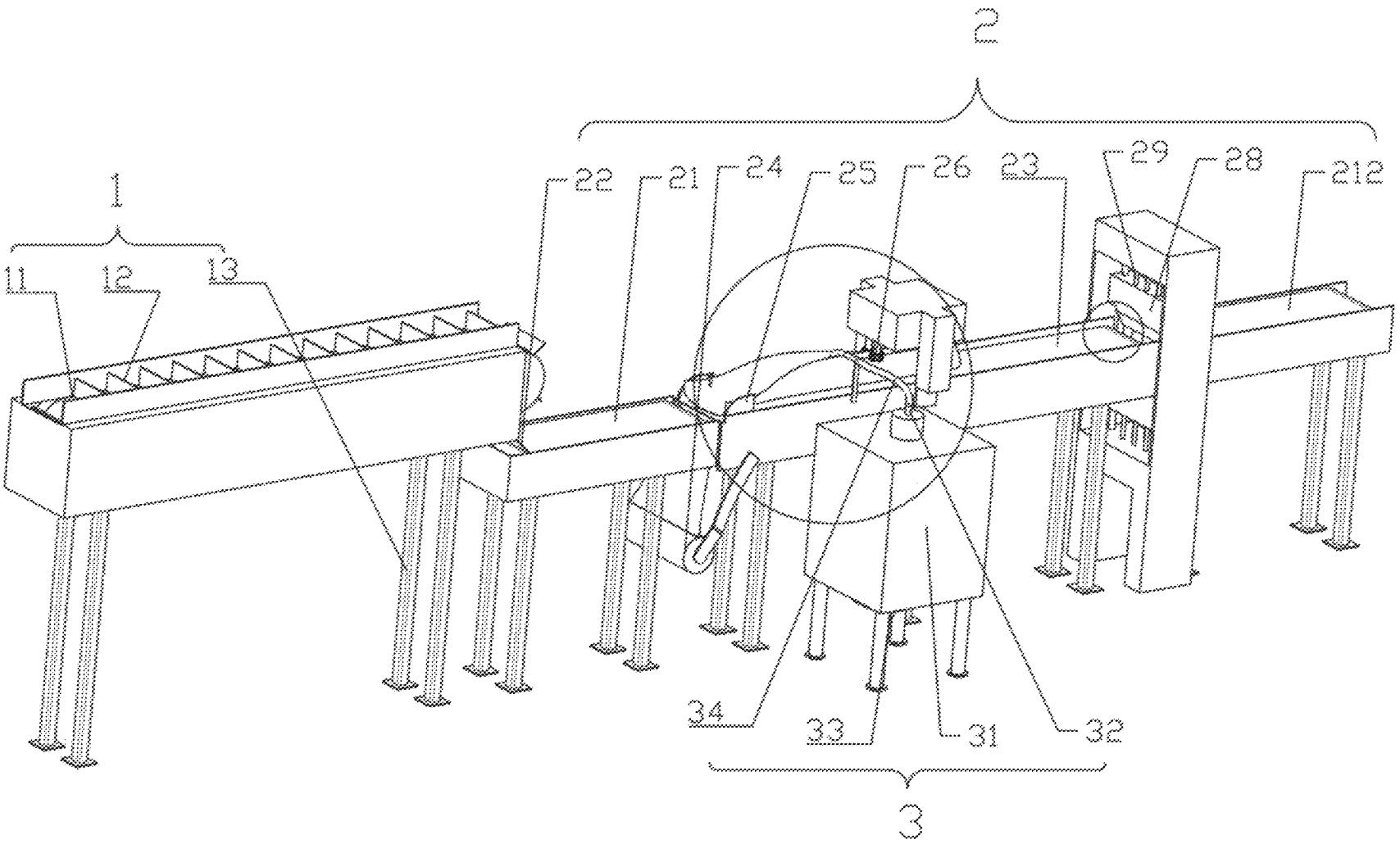
FIG. 1 is a schematic diagram of a structure of a plasma sterilization packaging device for agricultural products of an embodiment of the present invention.
Figure 2:
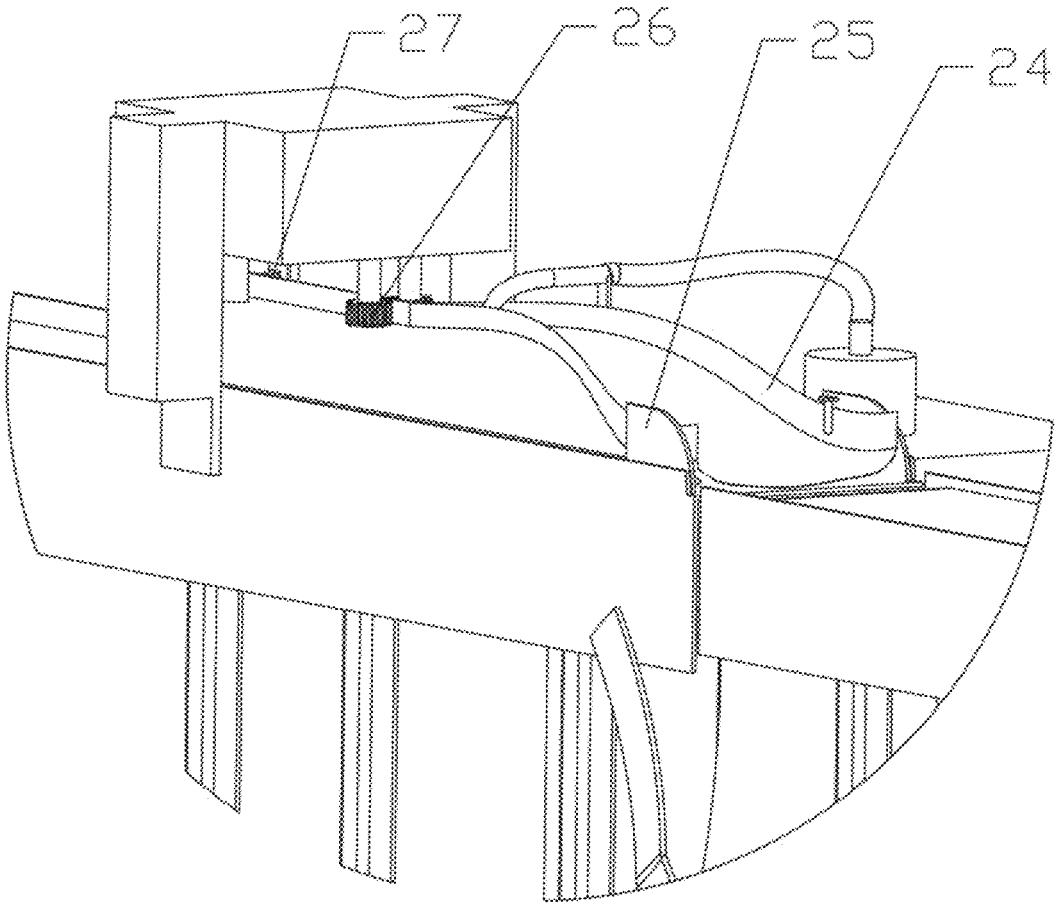
FIG. 2 is a partially enlarged diagram of an upper sealing device of a plasma sterilization packaging device for agricultural products of an embodiment of the present invention.
Figure 3:
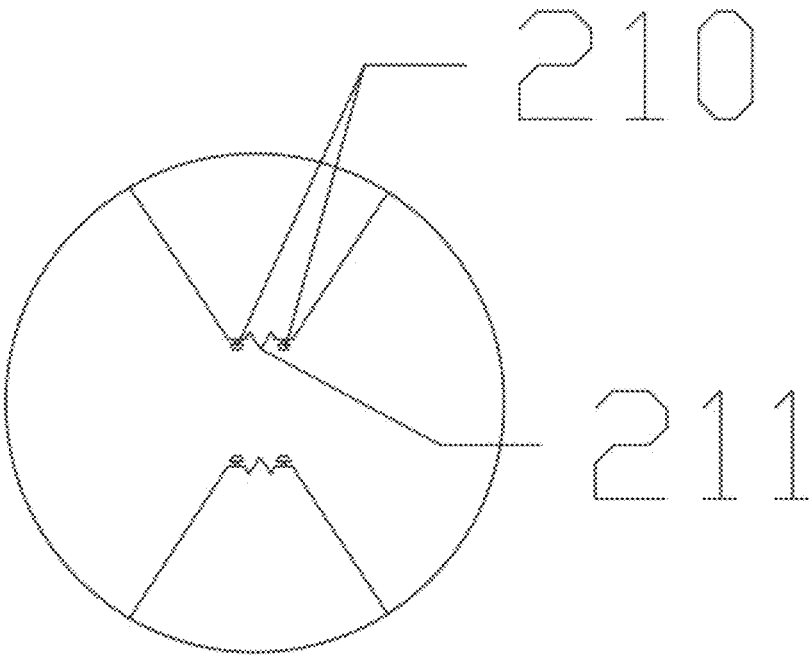
FIG. 3 is a partially enlarged diagram of a cutting sealing device of a plasma sterilization packaging device for agricultural products of an embodiment of the present invention.

As shown in FIGS. 1-3, the present invention provides a plasma sterilization packaging device for agricultural products, including a feeding unit 1 and a packaging unit 2 arranged on the side of the feeding unit 1.

The feeding unit 1 includes a feeding conveyor belt 11 with several baffles 12 arranged at equal intervals. A cavity is formed between each two adjacent baffles 12, and the bottom of the feeding conveyor belt 11 is fixed on ground through supporting leg 13.

The first conveyor belt 21 is connected to the feeding unit 1 through a transition plate 22.

The packaging unit 2 includes a first conveyor belt 21, an encapsulation conveyor belt 23 and a second conveyor belt 212, there is a gap between the first conveyor belt 21 and the encapsulation conveyor belt 23, as well as a gap between the encapsulation conveyor belt 23 and the second conveyor belt 212. The upper surface of the first conveyor belt 21, the encapsulation conveyor belt 23 and the second conveyor belt 212 are located on the same horizontal plane. The horizontal plane height of the first conveyor belt 21 is lower than the horizontal plane height of the feeding conveyor belt 11.

The upper side of the encapsulation conveyor belt 23 is equipped with a roll film adjustment device 25 and an upper sealing device, while the lower side of the first conveyor belt 21 is fitted with a roll film 24. A cutting sealing device is arranged between the encapsulation conveyor belt 23 and the second conveyor belt 212.

Wherein the roll film 24 is arranged on a reel, and both sides of the reel are fixedly connected to both sides of the encapsulation conveyor belt 23 through a connecting bar.

The roll film adjustment device is a thin plate, the thin plate is perpendicular to the upper surface of the encapsulation conveyor belt 23 and has a certain angle with the side surface of the encapsulation conveyor belt 23, one end of the thin plate near the inlet of the encapsulation conveyor belt 23 is rounded, and a cylinder is arranged at the other end, the cylinder is parallel to the thin plate and has a certain gap. The roll film adjustment device is the existing technology; which is no longer described in detail here.

The upper sealing device is fixedly connected to both sides of the encapsulation conveyor belt 23 through a first mounting frame, the lower side of the first mounting frame is provided with a hot pressing roller 27, the hot pressing roller 27 is provided with a sealing positioning wheel 26 on the side close to the roll film 24, the hot pressing roller 27 and the sealing positioning wheel 26 are at a same height, a heating sheet is arranged inside the hot pressing roller 27, and a rolling knurl is provided on the surface of the hot pressing roller 27.

The cutting sealing device includes a second mounting frame, a through hole is arranged on the second mounting frame, and the through hole is sleeved in a middle part of the second conveyor belt 212 and the encapsulation conveyor belt 23, and the upper and lower parts of the through hole are connected to a guillotine 28 through a push rod 29; both sides of the guillotine 28 are hot pressing blocks 210, the middle is a cutting knife 211, and the heating sheet is arranged inside each hot pressing block 210. The gap between the second conveyor belt 212 and the encapsulation conveyor belt 23 is in the same vertical line as the guillotine 28.

One side of the sealing positioning wheel 26 is further connected to a plasma processing unit 3; the plasma processing unit 3 includes a plasma generator 31, a power regulator and a gas supply device, the plasma generator 31 is a coaxial dual dielectric barrier reactor, the power regulator is a modulated pulse power, an output voltage is 0-30 kV, an output frequency is 5-20 KHz, the gas supply device is one of the gas cylinders or gas generators, and the gas provided by the gas supply device is one or more of air, nitrogen, oxygen and argon.

An upper interface of the plasma generator 31 is a gas output interface 32, the gas output interface 32 is fixed in front of the sealing positioning wheel 26 through a gas tube 34, a lower interface of the plasma generator 31 is a gas input interface 33, the gas input interface 33 is connected to an outlet of the gas supply device through the gas tube 34, the power regulator is electrically connected to the plasma generator 31.

Embodiment 2

The embodiment adopts the fast plasma sterilization packaging device in embodiment 1, and under the premise of ensuring that the production rhythm of the assembly line is 20 seconds and the plasma output frequency is 50 Hz, the experiment is carried out by changing the output voltage intensity; the specific steps are as follows:

1, the unpacked dried tangerines were sub-packed at 50 g per portion and stored in a culture box with a temperature of 35° C.-40° C. and a relative humidity of 20%-30% for 5 days;

2, the stored dried tangerines were put into the device in embodiment 1, and packaged after the plasma treatment was carried out with different intensity output voltages (0, 5, 10, 15, 20, 25, and 30 kV). The packaged dried tangerines were stored at a temperature of 15° C.-25° C. for 2 days;

3, after 2 days of storage, the aerobic plate count of dried tangerines treated with different voltages and dried tangerines without plasma treatment was detected according to the 'GB 4789.2-2022 national food safety standard-food microbiological examination-aerobic plate count determination'.

Figure 4:
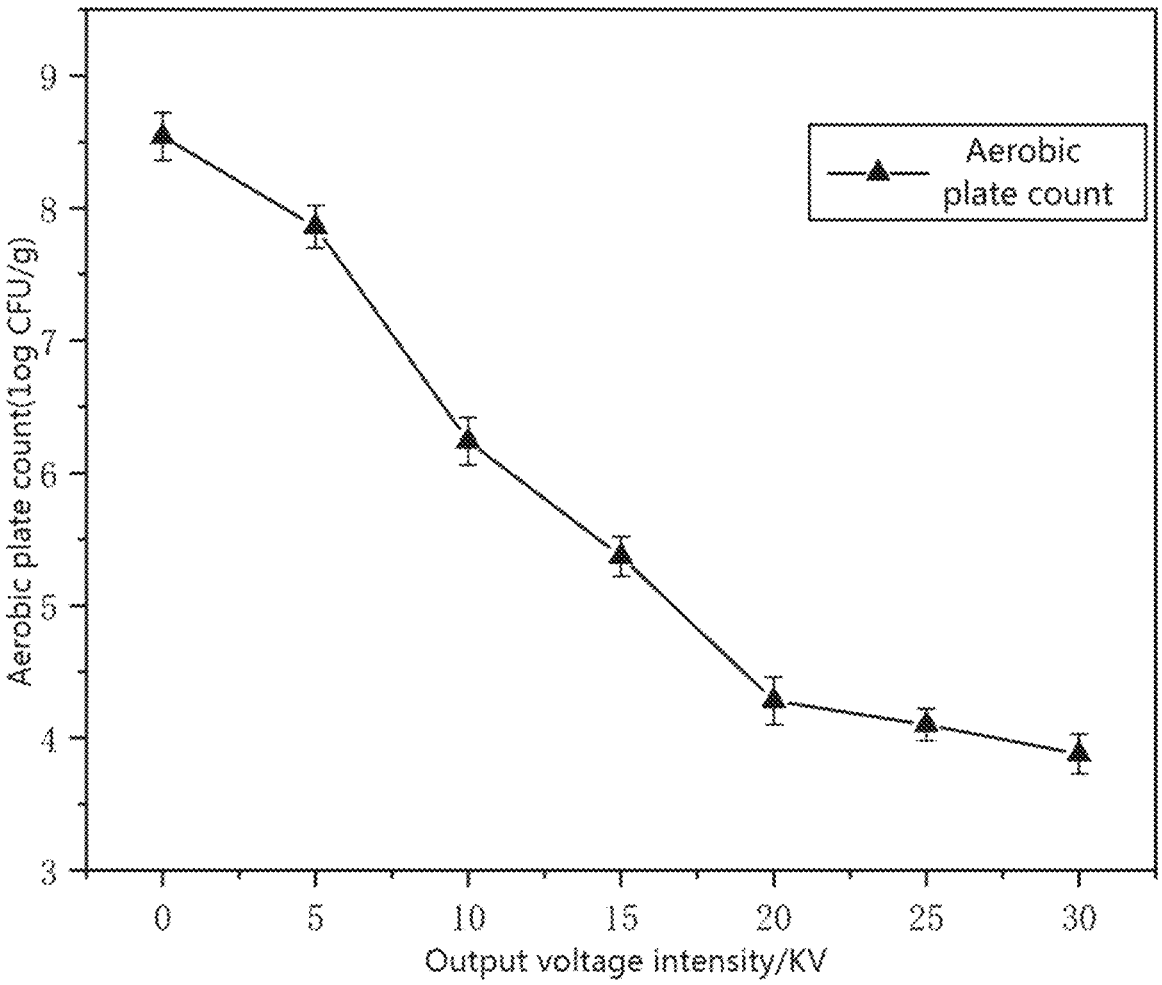
FIG. 4 is a diagram of a relationship between an output voltage intensity and an aerobic plate count in embodiment 2 of the present invention.

4, the results are shown in FIG. 4, the number of microorganisms in plasma-treated dried tangerines decreased significantly, and the aerobic plate count gradually decreased with the increase of output voltage intensity. The decreasing trend of the aerobic plate count tends to be slow when the output voltage reaches 20 kV.

Embodiment 3

The difference between this embodiment and embodiment 2 is that this embodiment fixes the output voltage at 20 kV and studies its impact by adjusting the production rhythm. The specific steps are as follows:

1, the unpacked dried tangerines were sub-packed at 50 g per portion and stored in a culture box with a temperature of 35° C.-40° C. and a relative humidity of 20%-30% for 5 days;

2, the stored dried tangerines were put into the device in embodiment 1, and plasma treatment and packaging were carried out at different production rhythms (10, 15, 20, 25, and 30 seconds). The packaged dried tangerines were stored at a temperature of 15° C.-25° C. for 2 days;

3, after 2 days of storage, the aerobic plate count of dried tangerines treated with different production rhythms was detected according to the 'GB 4789.2-2022 national food safety standard-food microbiological examination-aerobic plate count determination'.

Figure 5:
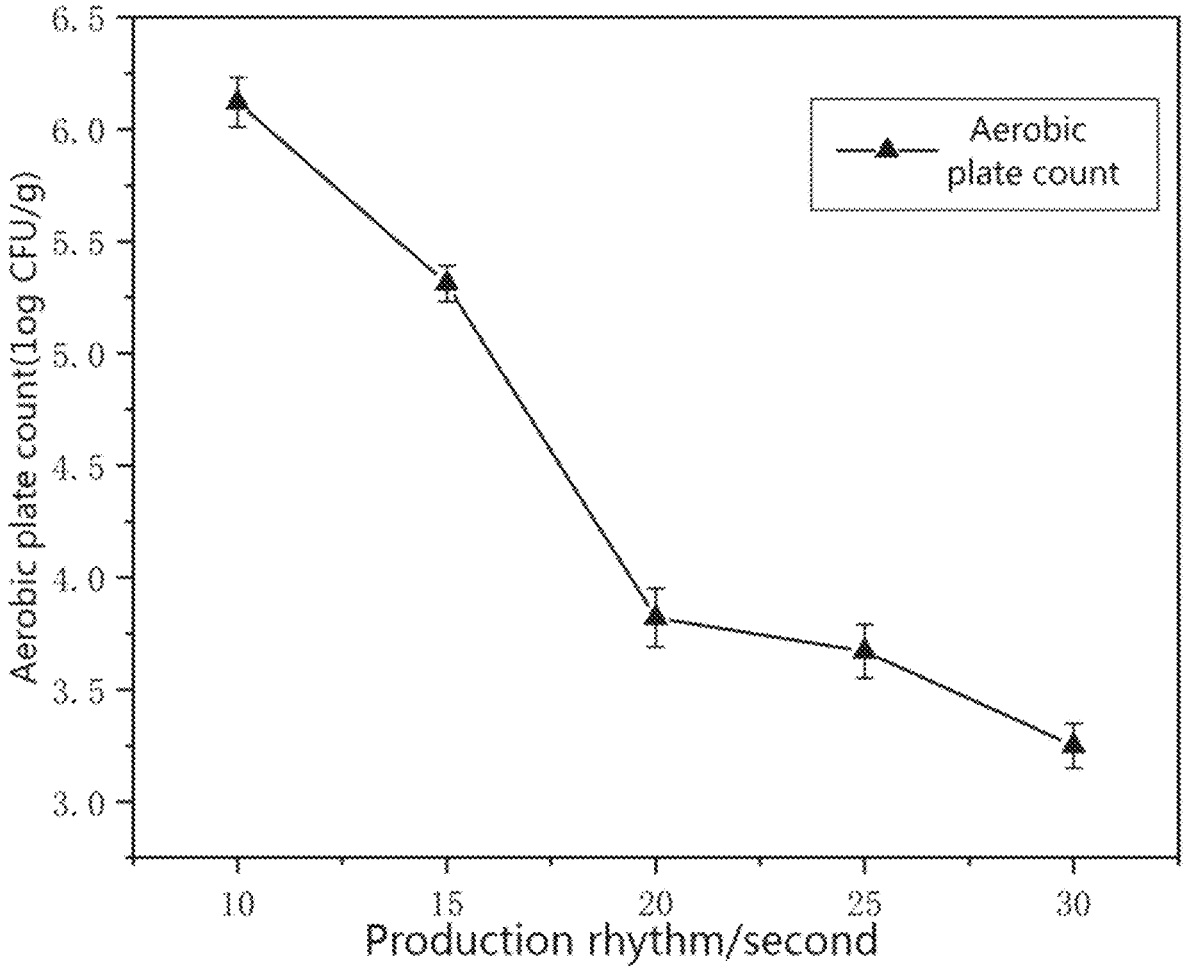
FIG. 5 is a diagram of a relationship between a production rhythm and an aerobic plate count in embodiment 3 of the present invention.

4, the results are shown in FIG. 5, with the prolongation of production rhythm, that is, the increase of the plasma treatment time, the aerobic plate count in the dried tangerines gradually decreased. The decreasing trend of the aerobic plate count began to slow down when the production rhythm reached 20 seconds.

Therefore, the invention adopts a plasma sterilization packaging device for agricultural products and using method thereof, compared with the conventional methods of 'sterilization before packaging' or 'packaging before sterilization', the processing time is reduced and the production efficiency is improved, and avoids the risk of secondary pollution and further ensures the safety and hygiene of the product.

Finally, it should be noted that the above examples are merely used for describing the technical solutions of the present invention, rather than limiting the same. Although the present invention has been described in detail with reference to the preferred examples, those of ordinary skill in the art should understand that the technical solutions of the present invention may still be modified or equivalently replaced. However, these modifications or substitutions should not make the modified technical solutions deviate from the spirit and scope of the technical solutions of the present invention.

What is claimed is:

1. A plasma sterilization packaging device for agricultural products, comprising a feeding unit and a packaging unit arranged on a side of the feeding unit;

wherein the packaging unit comprises a first conveyor belt, an encapsulation conveyor belt and a second conveyor belt, wherein a lower side of the first conveyor belt is provided with a roll film, an upper side of the encapsulation conveyor belt is provided with a roll film adjustment device and an upper sealing device, and a cutting sealing device is arranged between the encapsulation conveyor belt and the second conveyor belt;

the upper sealing device is fixedly connected to both sides of the encapsulation conveyor belt through a first mounting frame, a lower side of the first mounting frame is provided with a hot pressing roller, the hot pressing roller is provided with a sealing positioning wheel on a side adjacent to the roll film, and a side of the sealing positioning wheel is connected to a plasma processing unit;

the cutting sealing device comprises a second mounting frame, a through hole is arranged on the second mounting frame, and the through hole is sleeved in a middle part of the second conveyor belt and encapsulation conveyor belt, and upper and lower parts of the through hole are connected to a guillotine through a push rod; and both sides of the guillotine are hot pressing blocks, a middle of the guillotine is a cutting knife, and a heating sheet is arranged inside each of the hot pressing blocks;

when the plasma sterilization packaging device is used, the roll film is pulled to a gap between the first conveyor belt and the encapsulation conveyor belt; two sides of the roll film are pulled to pass through the roll film adjustment device, the roll film is bent through the roll film adjustment device to form a curved roll film; the curved roll film is pulled so that both sides of the curved roll film overlap; an overlapped part of the curved roll film is passed through the sealing positioning wheel and the hot pressing roller in sequence, and the overlapping part of the curved roll film is hot-pressed through the hot pressing roller to form a cylindrical shape with an opening at each of both ends;

the plasma processing unit is opened, an output voltage of which is set between 20-30 kV and an output frequency of which is set between 5-20 kHz, the first conveyor belt, the encapsulation conveyor belt and the second conveyor belt are opened at same time, and a production rhythm is set in 20-30 s;

weighed packaging materials to be sterilized is put into a cavity of the feeding unit; and the weighed packaging materials to be sterilized is fed into the curved roll film filled with a plasma gas through the first conveyor belt, the weighed packaging materials to be sterilized is sealed in the curved roll film filled with the plasma gas through the cutting sealing device under an action of the guillotine of the upper part and the guillotine of the lower part to form a single independent sealed bag.

2. The plasma sterilization packaging device for the agricultural products according to claim 1, wherein the feeding unit comprises a feeding conveyor belt, a plurality of baffles are arranged on the feeding conveyor belt at equal intervals, a cavity is formed between each two adjacent baffles, and a bottom of the feeding conveyor belt is fixed on ground through a supporting leg.

3. The plasma sterilization packaging device for the agricultural products according to claim 2, wherein the first conveyor belt is connected to the feeding unit through a transition plate.

4. The plasma sterilization packaging device for the agricultural products according to claim 3, wherein an upper surface of the first conveyor belt, an upper surface of the encapsulation conveyor belt and an upper surface of the second conveyor belt are located on a same horizontal plane, and a horizontal plane height of the first conveyor belt is lower than a horizontal plane height of the feeding conveyor belt.

5. The plasma sterilization packaging device for the agricultural products according to claim 4, wherein the roll film is arranged on a reel, and both sides of the reel each are fixedly connected to each of the both sides of the encapsulation conveyor belt through a connecting bar.

6. The plasma sterilization packaging device for the agricultural products according to claim 5, wherein the hot pressing roller and the sealing positioning wheel are at a same height, a heating sheet is arranged inside the hot pressing roller, and a rolling knurl is provided on a surface of the hot pressing roller.

7. The plasma sterilization packaging device for the agricultural products according to claim 6, wherein the plasma processing unit comprises a plasma generator, a power regulator and a gas supply device, wherein the plasma generator is a coaxial dual dielectric barrier reactor, the power regulator is a modulated pulse power, with an output voltage of 0-30 kV and an output frequency of 5-20 kHz, the gas supply device is either gas cylinders or gas generators, wherein the gas supply device provides one or more of air, nitrogen, oxygen, and argon.

8. The plasma sterilization packaging device for the agricultural products according to claim 7, wherein an upper interface of the plasma generator is a gas output interface, the gas output interface is fixed in front of the sealing positioning wheel through a gas tube, a lower interface of the plasma generator is a gas input interface, the gas input interface is connected to an outlet of the gas supply device through a gas tube, and the power regulator is electrically connected to the plasma generator.

* * * * *